United States Patent [19]

Zorini

[11] 4,007,609

[45] Feb. 15, 1977

[54] TWISTED BEARD NEEDLE

[75] Inventor: Luigi Omodeo Zorini, Cilavegna, Italy

[73] Assignee: Comez, S.p.A., Pavia, Italy

[22] Filed: Apr. 9, 1975

[21] Appl. No.: 566,278

[30] Foreign Application Priority Data

May 20, 1974 Italy ..... 22934/74

[52] U.S. Cl. ..... 66/116

[51] Int. Cl.[2] ..... D04B 35/02

[58] Field of Search ..... 66/116, 123, 119

[56] References Cited

UNITED STATES PATENTS

| | | | |
|---|---|---|---|
| 1,860,788 | 5/1932 | Potter | 66/119 |
| 2,633,721 | 4/1953 | Schoenster | 66/119 |
| 2,770,116 | 11/1956 | Morris | 66/119 |
| 3,364,702 | 1/1968 | Bux | 66/119 |

FOREIGN PATENTS OR APPLICATIONS

| | | | |
|---|---|---|---|
| 29,378 | 7/1964 | Germany | 66/119 |
| 197,320 | 11/1907 | Germany | 66/119 |
| 397,769 | 4/1922 | Germany | 66/119 |
| 377,413 | 12/1939 | Italy | 66/119 |
| 1,121 | 1/1889 | United Kingdom | 66/119 |

OTHER PUBLICATIONS

Reisfeld; A., Warp Knit Engineering, published by the National Knitted Outerwear Assoc., N.Y. 1966, p. 210.

*Primary Examiner*—Mervin Stein
*Assistant Examiner*—Andrew M. Falik
*Attorney, Agent, or Firm*—Stevens, Davis, Miller & Mosher

[57] ABSTRACT

Twisted beard needle for crochet frames raschel chain and similar products comprising a rectangular stem, a heel on one end of the stem and a beard with the needle point of the beard bent towards the heel on the other end of the stem in a direction displaced on the side with respect to the longitudinal axis of the needle and in repose being positioned within the cross section of the rectangular stem, the portion of the beard bent towards the heel consisting of two segments inclined upwardly to a point extending above the cross section of the rectangular stem to form an obstacle to the loop which slides on the beard so that the loop is obliged to slack its sliding and to widen to overcome the above-mentioned obstacle constituted by the point, said widening determining the recovery of the thread from the stitch previously formed to thereby tighten more the stitch.

2 Claims, 8 Drawing Figures

TWISTED BEARD NEEDLE

This invention relates to a twisted beard needle for crochet frames, raschel, raschel chain and similar products.

The twisted beard needles for knitting machines are substantially formed by a rectangular stem, a heel and a twisted beard obtained by bending the needle point, remarkably thin with respect to the needle stem, towards the heel according to a direction displaced on the side in respect of the longitudinal axis of the needle and parallel to this axis.

This needle type does not require, and the work "automatic" indicates it, the usual rod for closing of the beard when the needle reenters the stationary front guide bar to unload the stitch deposited on the needle stem, as the point bent towards the heel and the top of the stem build a continuous line along which the formed stitch can slide.

The needle loading with warp yarn occurs as the beard is displaced on the side in respect with the longitudinal axis of the needle, so that between beard and stem there occurs a load canal which interferes with this longitudinal needle axis and the weft guide bar carrying the thread lays-in the thread on the needle in correspondence with and according to the direction of this canal.

With automatic twisted beard needles having the point bent parallel to the needle axis and in a particular way in knitting machines with a high number of courses per minute, many times the thread is not inserted in the needle beard, as the bent point and the top of the stem build a straight continuous line and if the weft guide bar does not lay-in the thread perfectly according to the direction of the loading canal, the thread instead of entering this canal and therefore the beard, passes directly through the top of the beard without entering which causes the stitch to jump.

Besides the bands produced with this type of needle have little elasticity as the stitches forming the warp chains are more open than the ones produced with latch needles.

The purpose of this invention is to avoid the above mentioned inconveniences assuring the needle loading by the warp thread also in knitting machines with a high number of courses per minute and assuring a high degree of elasticity of the product i.e. at least a product similar to the one produced with latch needles.

This purpose is completely reached by the automatic twisted beard needle, subject of this invention, comprising a rectangular stem, a heel and a beard obtained by bending the needle point towards the the heel according a direction displaced on the side in respect to the longitudinal axis of the needle and parallel to this axis, comprising an angle placed on the top part of the beard bent towards the heel.

Other features and advantages of this invention are marked in the following detailed description for a illustrated realization form as example from enclosed drawings, such as:

Figure 1:
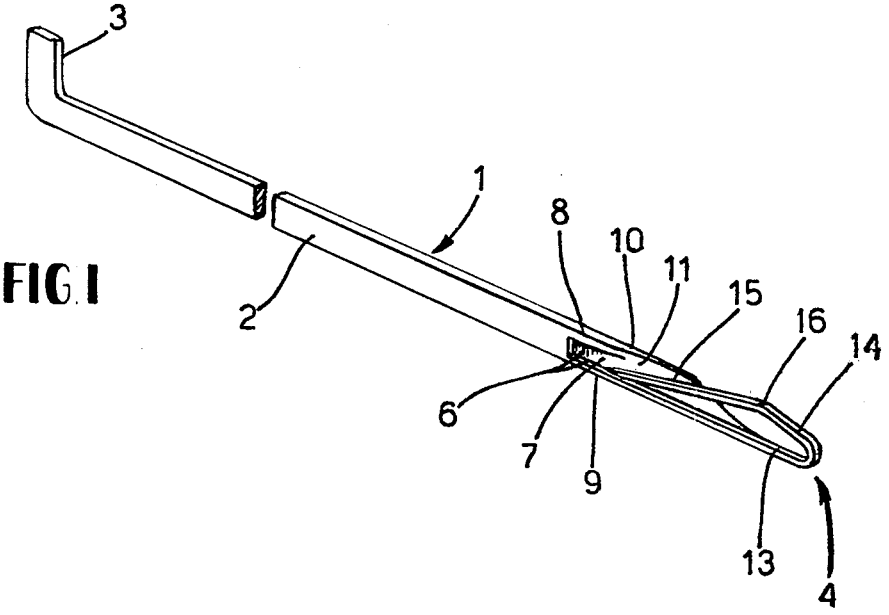
FIG. 1 illustrates a perspective view of a needle according to this invention.
Figure 2:
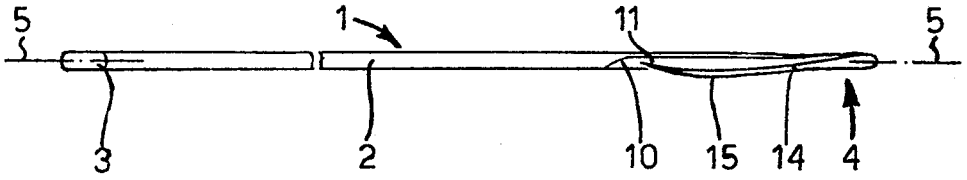
FIG. 2 illustrates a needle, whose view is mentioned in FIG. 1.

With reference to FIGS. 1 and 2 needle 1 is comprised of a rectangular stem 2, a heel 3 and a beard 4 on the side displaced in respect to the longitudinal axis 5 of the needle.

In the connection zone between stem 2 and beard 4 is a hollow 6 which presents a vertical wall 7 and two lateral walls 8 and 9.

On the lateral wall 8 is produced a stress raiser 10 so that between the vertical wall 7 of the hollow 6 and the beard 4 on the side moved there is a canal 11 for loading of a warp thread 12 (FIGS. 3, 4, 5, 6, 7 and 8).

The beard 4 is built by a bottom straight part 13 on the axis with the lateral wall 9, of which it is considered as a prolongation, and two top elements 14 and 15 inclined and directed upwards to a point 16 to form an angle on the top part of the beard.

The section composed of straight bottom part 13 and top elements 14 and 15 is much lower than the section of the needle stem and coincides with the section of the lateral wall 9.

The top element 15, coinciding with the needle point, is prolongated to reach the hollow 6.

As better seen in FIG. 2, the top elements 14 and 15 of the beard are displaced on the side in respect with the longitudinal axis of the needle so that between the vertical wall 7 of the hollow 6 in correspondence with the stress raiser 10 there is the canal 11 for thread loading.

In the FIGS. 3, 4, 5, 6, 7 and 8 and for better comprehension of the function of the top elements 14 and 15 inclined and directed upwards to a point 16, there is represented a part of stationary front guide bar 17 in whose hollows 18 the needles 1 are sliding supported by a mobile front guide bar not illustrated.

Before the stationary front guide bar there is a tube 19 through which the yarn thread 20 passes and a weft tube 21 through which the thread 12 passes which must be loaded on the needle 1 for forming a stitch 22 and ultimately a chain 23. Needle 1 operates in the following manner.

Figure 3:
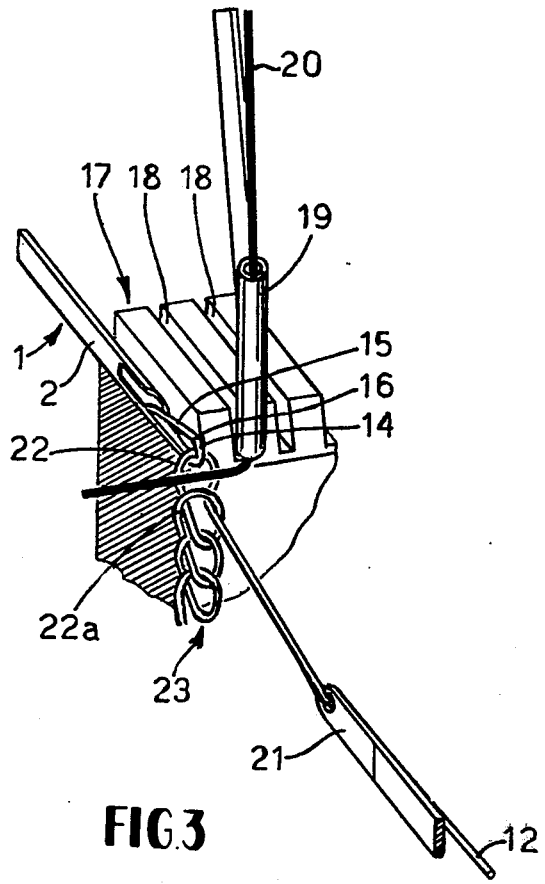
FIGS. 3, 4, 5, 6, 7 and 8 illustrate, a perspective view of a needle according to this invention and other frame parts in the positions which they assume during the stitch formation.

As illustrated in FIG. 3 the point 22 is hooked by the beard 4 and the thread 12 coming from the weft tube 21 passes the point 22*a* previously formed.

The needle is at the maximum distance from the weft 21 in its re-entered position in the stationary guide bar.

During this rest phase of the needle the weft tube 21 passes before the stationary front guide bar and lays-in the yarn thread 20 before the stitch 22.

In the following phase illustrated in FIG. 4 the needle moves out from the stationary front guide bar and is at the min. distance from the weft tube 21 while the point 22, sliding on the stress raiser 10, going out of the beard lays-in on the needle stem 2.

Figure 5:
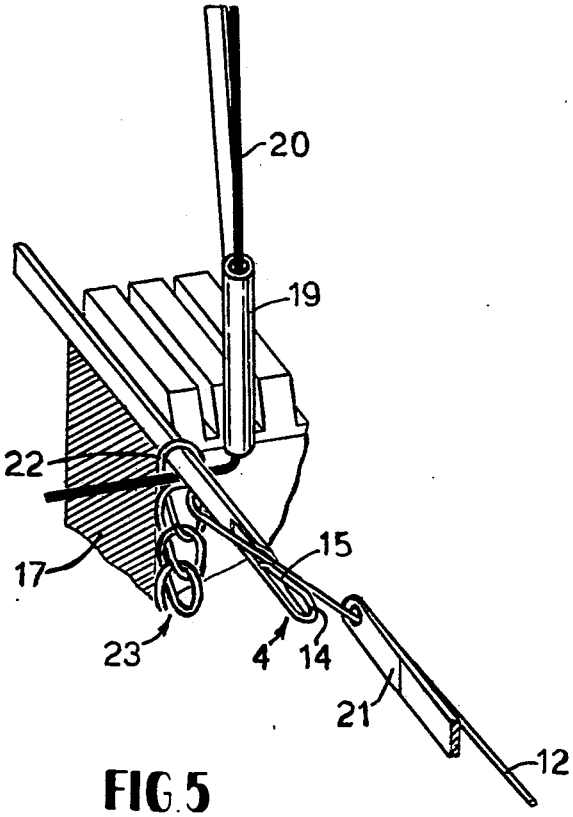
Figure 6:
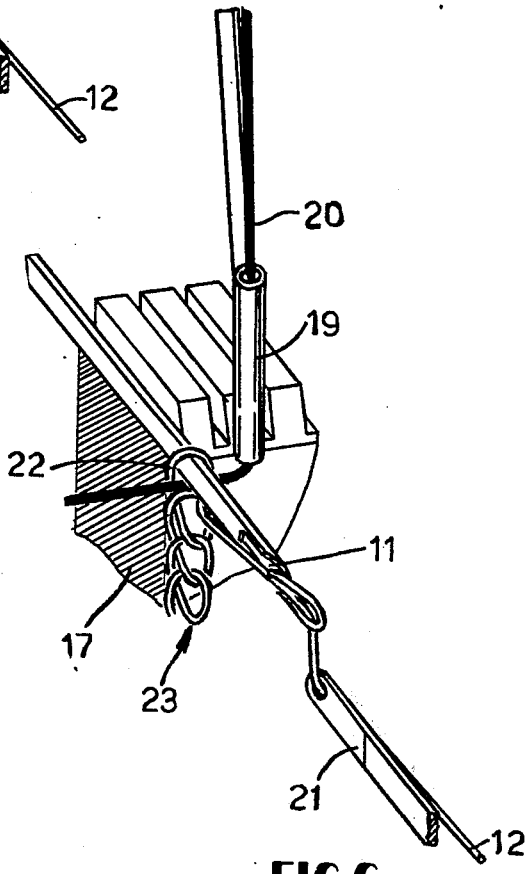

Now, as illustrated in FIG. 5, the needle loading is begun from the weft tube 21 which moves from the left to the right side of the longitudinal axis of the needle following an orbital trajectory around this axis, thereby laying-in the thread on the needle in correspondence with the loading canal 11.

Figure 4:
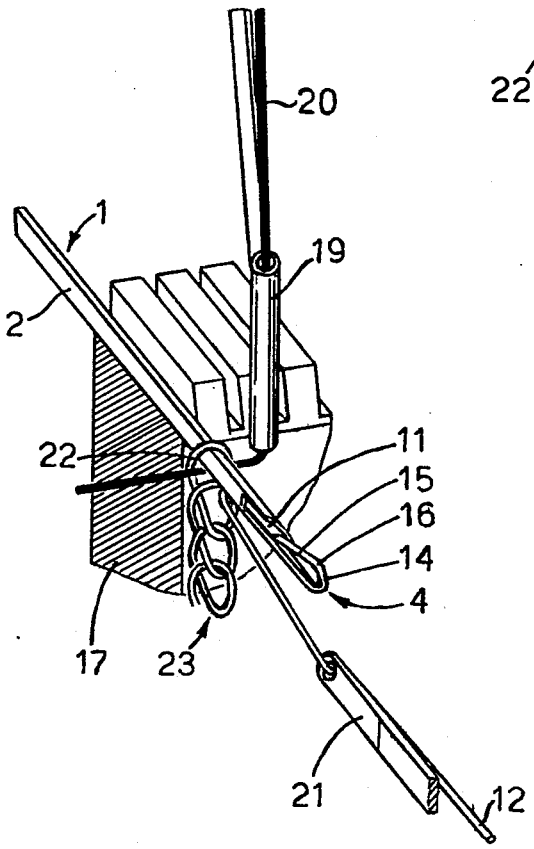

The part 15 of the beard inclined towards the hollow 6 assures the sliding of the thread into the loading canal 11 and thereafter into the beard 4 as illustrated on FIGS. 3 and 4.

Figure 8:
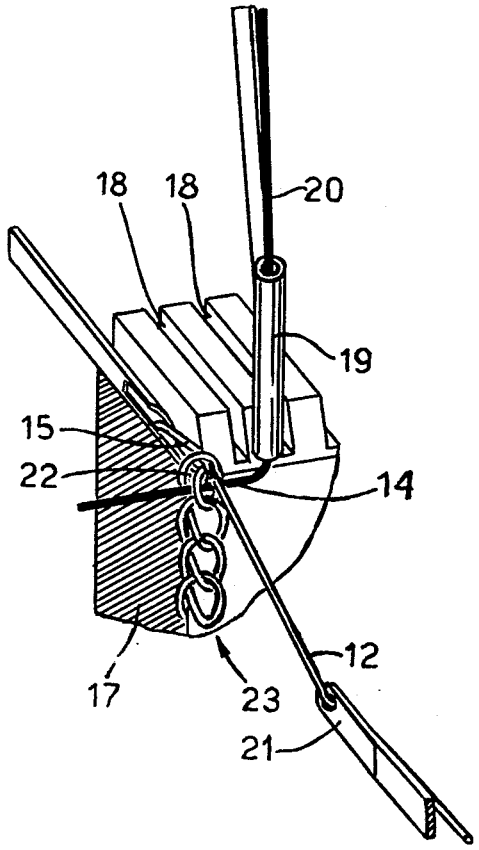
Figure 7:
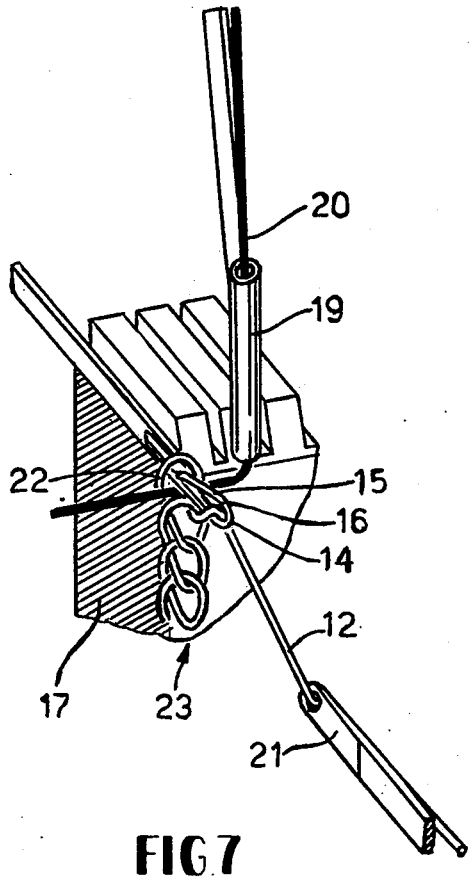

The needle when re-entering the stationary front guide bar, FIG. 7, compels the stitch 22 to slide along the stem and on to the top part of the beard to reach the point 16 as illustrated on FIG. 8; after which it slides along the inclined part 14 for unloading.

As previously stated the point 16 builds the buckle which determines during the unloading stitch phase an updraw or better a tension of the thread deposited on the top part of the beard determining a better uniformity of stitch formation and therefore also a better elasticity.

Also the stitch unloading phase after reaching the point 16 is remarkable facilitated because the top part 14 is inclined downhill.

A possible variation not illustrated could be that the buckle on the top part of the beard determined by the point 16 where the inclined elements 14 and 15 pass could be realized through material applied to the top part of the beard.

What is claimed is:

1. Twisted Beard needle for crochet frames, raschel, raschel chain and similar products comprising a rectangular stem, a heel on one end of said stem and a beard with the needle point of the beard bent towards the heel on the other end of said stem in a direction displaced on the side with respect to the longitudinal axis of the needle and in repose being positioned within the cross section of the rectangular stem, the portion of the beard bent towards the heel consisting of two segments inclined upwardly to a point extending above the cross section of the rectangular stem to form an obstacle to the loop which slides on the beard so that the loop is obliged to slack its sliding and to widen to overcome the abovementioned obstacle constituted by the point, said widening determining the recovery of the thread from the stitch previously formed to thereby tighten more said stitch.

2. The needle according to claim 1 wherein the top part of the beard has material applied thereto to form an upper surface having an angle therein of the beard bent towards the heel.

* * * * *